US011073311B2

(12) United States Patent
Warner et al.

(10) Patent No.: US 11,073,311 B2
(45) Date of Patent: Jul. 27, 2021

(54) CLIMATE-CONTROL SYSTEM HAVING PUMP

(71) Applicant: Emerson Climate Technologies, Inc., Sidney, OH (US)

(72) Inventors: Wayne R. Warner, Grand Junction, CO (US); Reza Khatami, Bellbrook, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 93 days.

(21) Appl. No.: 16/413,117

(22) Filed: May 15, 2019

(65) Prior Publication Data

US 2019/0353409 A1 Nov. 21, 2019

Related U.S. Application Data

(60) Provisional application No. 62/672,741, filed on May 17, 2018.

(51) Int. Cl.

| | |
|---|---|
| ***F25B 25/00*** | (2006.01) |
| ***F25B 49/02*** | (2006.01) |
| ***F25B 41/385*** | (2021.01) |

(52) U.S. Cl.

CPC ..... *F25B 25/005* (2013.01); *F25B 49/022* (2013.01); *F25B 41/385* (2021.01); *F25B 2700/195* (2013.01)

(58) Field of Classification Search

CPC ..... F25B 2341/0661; F25B 25/005; F25B 2700/195; F25B 49/022; F25B 2400/24; F24F 5/0017

(Continued)

(56) References Cited

U.S. PATENT DOCUMENTS

| | | | | |
|---|---|---|---|---|
| 9,441,861 | B2 | 9/2016 | Diamond et al. | |
| 2006/0137853 | A1* | 6/2006 | Haller | B60H 1/323 165/42 |

(Continued)

FOREIGN PATENT DOCUMENTS

| | | | |
|---|---|---|---|
| JP | H09310894 | A | 12/1997 |
| JP | H10281579 | A | 10/1998 |

(Continued)

OTHER PUBLICATIONS

Written Opinion of the ISA/KR regarding International Application No. PCT/US2019/032724 dated Sep. 2, 2019.

(Continued)

*Primary Examiner* — Henry T Crenshaw

(74) *Attorney, Agent, or Firm* — Harness, Dickey & Pierce, P.L.C.

(57) ABSTRACT

A climate-control system includes a first working-fluid circuit, a second working-fluid circuit and a first heat exchanger. The first working-fluid circuit includes a first compressor, a second heat exchanger and a first pump. The second heat exchanger is in fluid communication with the first compressor. The first pump receives a first working fluid from the second heat exchanger and circulates the first working fluid through the first working-fluid circuit. The second working-fluid circuit is fluidly isolated from the first working-fluid circuit and includes a second pump and a fourth heat exchanger. The second pump is in fluid communication with the fourth heat exchanger. The first heat exchanger is thermally coupled with the first working-fluid circuit and the second working-fluid circuit.

21 Claims, 2 Drawing Sheets

(58) Field of Classification Search
USPC ..... 62/199
See application file for complete search history.

(56) References Cited

U.S. PATENT DOCUMENTS

| | | | | |
|---|---|---|---|---|
| 2011/0289953 | A1* | 12/2011 | Alston | B60H 1/32 62/238.6 |
| 2015/0000317 | A1* | 1/2015 | Murakami | H05K 7/20836 62/190 |
| 2015/0239324 | A1* | 8/2015 | Kolda | B60H 1/3232 62/239 |
| 2017/0336085 | A1* | 11/2017 | Yasuo | F24F 11/89 |
| 2018/0283709 | A1* | 10/2018 | Al-Hallaj | F28F 27/00 |

FOREIGN PATENT DOCUMENTS

| | | | |
|---|---|---|---|
| JP | 2003050059 | A | 2/2003 |
| JP | 2007292352 | A | 11/2007 |
| KR | 20120055154 | A | 5/2012 |

OTHER PUBLICATIONS

International Search Report regarding International Application No. PCT/US2019/032724 dated Sep. 2, 2019.

* cited by examiner

CLIMATE-CONTROL SYSTEM HAVING PUMP

CROSS-REFERENCE TO RELATED APPLICATIONS

This application claims the benefit of U.S. Provisional Application No. 62/672,741, filed on May 17, 2018. The entire disclosure of the above application is incorporated herein by reference.

FIELD

The present disclosure relates to a climate-control system having a pump.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, one or more indoor heat exchangers, one or more expansion devices, and one or more compressors circulating a working fluid (e.g., refrigerant or carbon dioxide) through the fluid circuit. Efficient and reliable operation of the climate control system is desirable to ensure that the climate-control system is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a climate-control system that includes a first working-fluid circuit, a second working-fluid circuit and a first heat exchanger. The first working-fluid circuit includes a first compressor, a second heat exchanger and a first pump. The second heat exchanger is in fluid communication with the first compressor. The first pump receives a first working fluid from the second heat exchanger and circulates the first working fluid through the first working-fluid circuit. The second working-fluid circuit includes a second pump and a fourth heat exchanger. The second pump is in fluid communication with the fourth heat exchanger. The first heat exchanger is thermally coupled with the first working-fluid circuit and the second working-fluid circuit.

In some configurations, the first working-fluid circuit and the second working-fluid circuit are in a heat transfer relationship with each other.

In some configurations of the climate-control system of any one or more of the above paragraphs, the first working-fluid circuit includes a third heat exchanger. The third heat exchanger may be disposed downstream of the first pump.

In some configurations of the climate-control system of any one or more of the above paragraphs, the first working-fluid circuit includes a first expansion device. The first expansion device may be disposed downstream of the first pump between the first pump and the third heat exchanger.

In some configurations of the climate-control system of any one or more of the above paragraphs, the first working-fluid circuit includes a second expansion device. The second expansion device may be disposed downstream of the first pump between the first pump and a conduit of the first heat exchanger.

In some configurations of the climate-control system of any one or more of the above paragraphs, the first working-fluid circuit includes a second compressor. The second compressor may be disposed between the conduit of the first heat exchanger and the first compressor.

In some configurations of the climate-control system of any one or more of the above paragraphs, a storage tank containing phase-change material is thermally coupled with the second working-fluid circuit.

In some configurations of the climate-control system of any one or more of the above paragraphs, a fourth heat exchanger of the second working-fluid circuit is disposed within the storage tank.

In some configurations of the climate-control system of any one or more of the above paragraphs, the first pump is in an ON-mode when the climate-control system is in a charge-mode.

In some configurations of the climate-control system of any one or more of the above paragraphs, an ambient temperature is equal to 60 degrees Fahrenheit.

In some configurations of the climate-control system of any one or more of the above paragraphs, an ambient temperature is below 60 degrees Fahrenheit.

In some configurations of the climate-control system of any one or more of the above paragraphs, a second working fluid circulates through the second working-fluid circuit. The first working fluid and the second working fluid are different from each other.

In some configurations of the climate-control system of any one or more of the above paragraphs, the first working-fluid circuit includes first and second fluid passageways. The first and second expansion devices may control flow through the first and second fluid passageways, respectively.

In some configurations of the climate-control system of any one or more of the above paragraphs, the first working-fluid circuit includes a third fluid passageway. A valve may control flow through the third fluid passageway.

In some configurations of the climate-control system of any one or more of the above paragraphs, the climate-control system is operable in a charge mode and a discharge mode.

In some configurations of the climate-control system of any one or more of the above paragraphs, the first working fluid flows through the first and second fluid passageways and is restricted from flowing through the third fluid passageway when the climate-control system is in the charge mode, and the first working fluid flows through the first and third fluid passageways and is restricted from flowing through the second fluid passageway when the climate-control system is in the discharge mode.

In another form, the present disclosure provides a climate-control system that includes a first working-fluid circuit, a second working-fluid circuit, a first heat exchanger, a pressure sensor and a control module. The first working-fluid circuit includes a first compressor, a second heat exchanger and a first pump. The second heat exchanger is in fluid communication with the first compressor. The first pump receives a first working fluid from the second heat exchanger via a fluid line and circulates the first working-fluid circuit through the first working-fluid circuit. The second working-fluid circuit includes a second pump and a fourth heat exchanger. The second pump in fluid communication with the fourth heat exchanger. The first heat exchanger thermally coupled with the first working-fluid circuit and the second working-fluid circuit. The pressure sensor coupled to the fluid line. The control module is in communication with the first pump and the pressure sensor. The control module operates the first pump in an ON-mode when the climate-control system is in a charge-mode and a pressure of the first working fluid in the fluid line is below a predetermined value.

In some configurations of the climate-control system of the above paragraph, the first working-fluid circuit and the second working-fluid circuit are in a heat transfer relationship with each other.

In some configurations of the climate-control system of any one or more of the above paragraphs, the first working-fluid circuit includes a third heat exchanger. The third heat exchanger may be disposed downstream of the first pump.

In some configurations of the climate-control system of any one or more of the above paragraphs, the first working-fluid circuit includes a first expansion device. The first expansion device may be disposed downstream of the first pump and between the first pump and the third heat exchanger.

In some configurations of the climate-control system of any one or more of the above paragraphs, the first working-fluid circuit includes a second expansion device. The second expansion device may be disposed downstream of the first pump and between the first pump and a conduit of the first heat exchanger.

In some configurations of the climate-control system of any one or more of the above paragraphs, the first working-fluid circuit includes a second compressor. The second compressor may be disposed between the conduit of the first heat exchanger and the first compressor.

In some configurations of the climate-control system of any one or more of the above paragraphs, a storage tank containing phase-change material is thermally coupled with the second working-fluid circuit.

In some configurations of the climate-control system of any one or more of the above paragraphs, a fourth heat exchanger of the second working-fluid circuit is disposed within the storage tank.

In some configurations of the climate-control system of any one or more of the above paragraphs, the first pump is in an ON-mode when the climate-control system is in a charge-mode.

In some configurations of the climate-control system of any one or more of the above paragraphs, an ambient temperature is equal to 60 degrees Fahrenheit.

In some configurations of the climate-control system of any one or more of the above paragraphs, an ambient temperature is below 60 degrees Fahrenheit.

In some configurations of the climate-control system of any one or more of the above paragraphs, a second working fluid circulates through the second working-fluid circuit. The first working fluid and the second working are different form each other.

In some configurations of the climate-control system of any one or more of the above paragraphs, the first working-fluid circuit includes first and second fluid passageways. The first and second expansion devices may control flow through the first and second fluid passageways, respectively.

In some configurations of the climate-control system of any one or more of the above paragraphs, the first working-fluid circuit includes a third fluid passageway. A valve may control flow through the third fluid passageway.

In some configurations of the climate-control system of any one or more of the above paragraphs, the climate-control system is operable in a charge mode and a discharge mode.

In some configurations of the climate-control system of any one or more of the above paragraphs, the first working fluid flows through the first and second fluid passageways and is restricted from flowing through the third fluid passageway when the climate-control system is in the charge mode, and the first working fluid flows through the first and third fluid passageways and is restricted from flowing through the second fluid passageway when the climate-control system is in the discharge mode.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
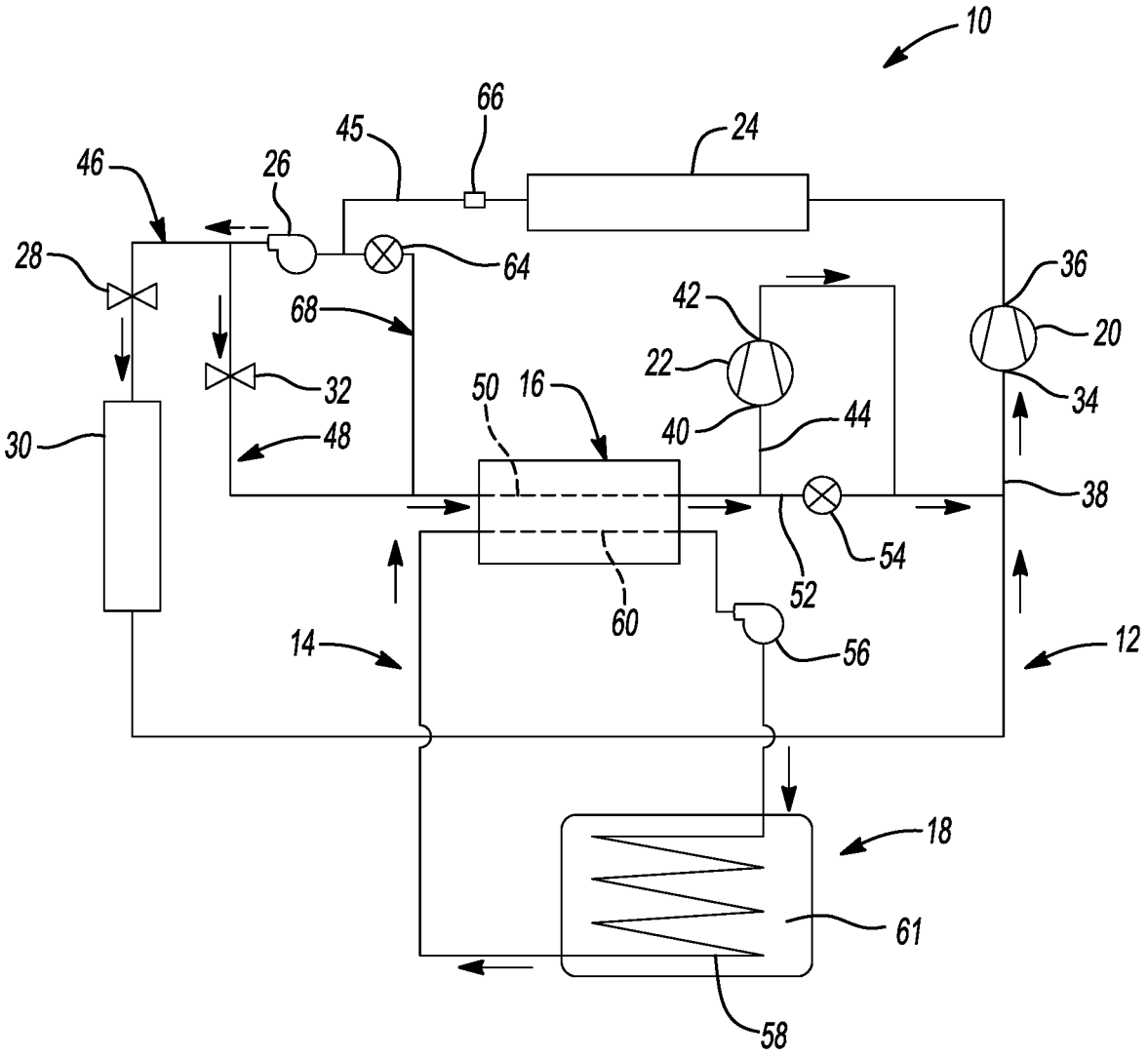
FIG. 1 is a schematic representation of a climate-control system in a charge-mode according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
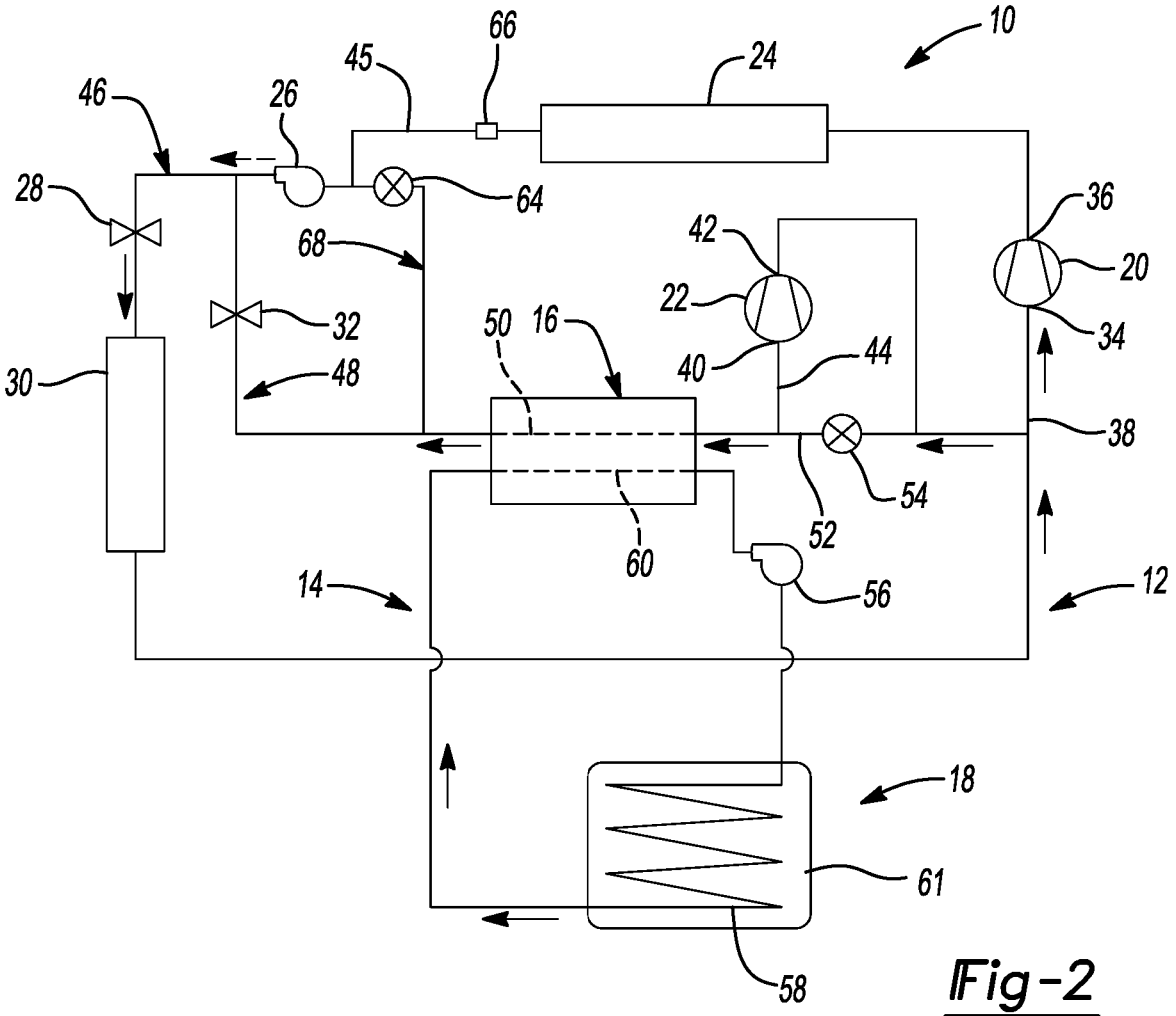
FIG. 2 is a schematic representation of the climate-control system in a discharge mode.

With reference to FIGS. 1 and 2, a climate-control system 10 is provided that may be operable between a charge mode (i.e., ice-making mode) and a discharge mode (i.e., ice-melting mode). The climate-control system 10 may include a first working-fluid circuit 12, a second working-fluid circuit 14, a first heat exchanger 16 and a thermal storage tank 18. The first working-fluid circuit 12 and the second working-fluid circuit 14 may be in a heat transfer relationship (i.e., thermally coupled) with each other. The first working-fluid circuit 12 and the second working-fluid circuit 14 may also be fluidly isolated from each other.

The first working-fluid circuit 12 may include first and second compressors 20, 22, a second heat exchanger 24 (an outdoor heat exchanger such as a condenser or gas cooler, for example), a first pump 26, a first expansion device 28, a third heat exchanger 30 (an indoor heat exchanger such as a medium-temperature evaporator, for example) and a second expansion device 32.

One or both of the first and second compressors 20, 22 may pump a first working fluid (e.g., natural refrigerant such as ammonia, CO2 and synthetic refrigerants, for example) through the first working-fluid circuit 12. One or both of the first and second compressors 20, 22 could be a scroll compressor, for example, or any other type of compressor such as a reciprocating or rotary vane compressor, for example. The first and second compressors 20, 22 could be of the same or different sizes and/or capacities. One or both of the first and second compressors 20, 22 may be a variable-capacity compressor operable in full capacity mode and a reduced capacity mode. In some configurations, the first and second compressors 20, 22 could include additional or alternative capacity modulation capabilities (e.g., variable-speed motor, vapor injection, blocked suction, etc.).

The first compressor 20 may include a first inlet 34 and a first outlet 36. The first inlet 34 may receive the first working fluid from a first suction line 38. The first working fluid received through the first inlet 34 may be compressed in the first compressor 20 and discharged through the first outlet 36 to the second heat exchanger 24. The second compressor 22 may include a second inlet 40 and a second outlet 42. The second inlet 40 may receive the first working fluid from a second suction line 44. The first working fluid received through the second inlet 40 may be compressed in the second compressor 22 and discharged through the second outlet 42 to the first suction line 38 and back into the first compressor 20.

The second heat exchanger 24 may receive the compressed first working fluid from the first compressor 20 and may transfer heat from the first working fluid to ambient air that may be forced over the second heat exchanger 24 by a fan (not shown). In some configurations, the second heat exchanger 24 may transfer heat from the compressed first working fluid to a stream of liquid such as water, for example. From the second heat exchanger 24, the first working fluid in the form of saturated liquid may flow to the first pump 26 via a liquid or fluid line 45. The first pump 26 may circulate a portion of the first working fluid into a first fluid passageway 46 and another portion of the first working fluid into a second fluid passageway 48. In some configurations, the first pump 26 may be a variable speed pump, which allows for control/optimization of fluid flow through the first pump 26.

The first fluid passageway 46 may include the first expansion device 28 and the third heat exchanger 30. The first expansion device 28 (e.g., an expansion valve or capillary tube) may be disposed between the first pump 26 and the third heat exchanger 30. The first expansion device 28 may control fluid flow from the first pump 26 to the third heat exchanger 30 such that the first working fluid downstream of the first expansion device 28 has a lower pressure and temperature than the first working fluid upstream of the first expansion device 28. The first working fluid in the third heat exchanger 30 may absorb heat from a space to be cooled (e.g., room(s) in a home or building, an interior of a refrigerator, a refrigerated display case, or a cooler). From the third heat exchanger 30, the first working fluid may flow into the first suction line 38 and subsequently back into the first compressor 20 through the first inlet 34.

The second fluid passageway 48 may include the second expansion device 32 (e.g., an expansion valve or capillary tube) that may be disposed between the first pump 26 and a first conduit 50 of the first heat exchanger 16. The second expansion device 32 may control fluid flow from the first pump 26 to the first conduit 50 such that the first working fluid downstream of the second expansion device 32 has a lower pressure and temperature than the first working fluid upstream of the second expansion device 32. From the first conduit 50, the first working fluid may flow through the second suction line 44 and into the second compressor 22 via the second inlet 40.

In some configurations, a bypass passageway 52 may provide selective fluid communication between the first conduit 50 and the first suction line 38 (i.e., bypassing the second compressor 22). A bypass valve 54 may be disposed in the bypass passageway 52 and may be movable between open and closed positions. In the closed position, the bypass valve 54 may restrict or prevent fluid-flow from the first conduit 50 to the first suction line 38 via the bypass passageway 52. In the open position, the bypass valve 54 may allow fluid to flow from the first conduit 50 to the first suction line 38 via the bypass passageway 52. It will be appreciated that the bypass valve 54 could be a solenoid valve, a mechanical valve actuated by fluid-pressure differentials, or an electronic expansion valve, for example, or any other type of valve.

The second working-fluid circuit 14 may include a second pump 56 and a fourth heat exchanger 58. The second pump 56 may be disposed between a second conduit 60 of the first heat exchanger 16 and the fourth heat exchanger 58 and may circulate a second working fluid (e.g., glycol) through the second working-fluid circuit 14.

The fourth heat exchanger 58 may be disposed within the storage tank 18 such that the fourth heat exchanger 58 is in a heat transfer relationship (i.e., thermally coupled) with the storage tank 18. From the fourth heat exchanger 58, the second working fluid may flow through the second conduit 60 and back to the second pump 56.

The thermal storage tank 18 may define a chamber filled with phase-change material 61 such as water or glycol, for example. The phase change-material 61 within the thermal storage tank 18 may be in the form of ice, for example, that is usable by the climate control system 10. In some configurations, additives such as alcohol or calcium chloride ($CaCl_2$)) may be mixed into the phase-change material 61 to vary (e.g., raise or lower) the temperature at which the phase-change occurs.

Figure 3:
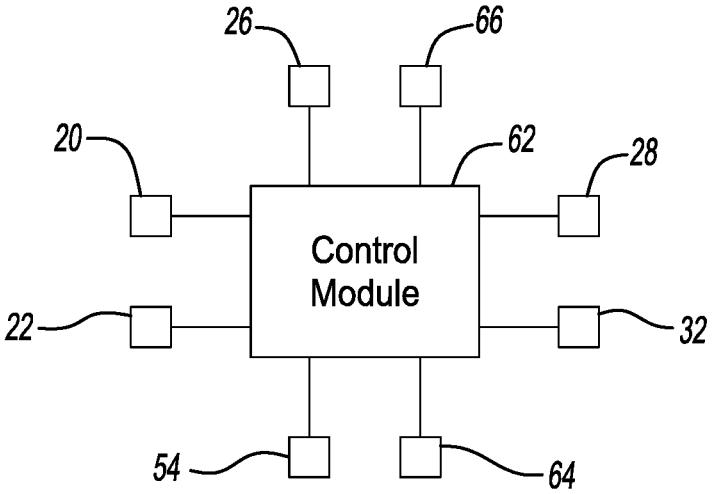
FIG. 3 is a block diagram illustrating communication between a control module and components of the climate-control system of FIG. 1.

As shown in FIG. 3, a control module 62 may be in communication with the first and second compressors 20, 22, the first and second expansion devices 28, 32, the first pump 26, the bypass valve 54, a valve 64 (e.g., a solenoid valve) and a pressure sensor 66 coupled to the liquid line 45. The control module 62 may control operation of the first and second compressors 20, 22, the first and second expansion devices 28, 32, the first pump 26, the bypass valve 54 and the valve 64. The operating mode of the first pump 26 of the first working-fluid circuit 12 may be at least partially based on data that the control module 62 receives from the pressure sensor 66 coupled to the liquid line 45. That is, when the climate control system 10 is operating in the charge-mode (ice-making mode) and the discharge-mode (ice-melting mode), the control module 62 may control whether the first pump 26 is in an ON mode or an Off mode based on data received from the pressure sensor 66.

When operating the climate-control system 10 in the charge mode (FIG. 1), the control module 62 closes the bypass valve 54 and the valve 64, and obtains the pressure of the first working fluid flowing through the liquid line 45 via the pressure sensor 66. If the pressure of the first working fluid flowing through the liquid line 45 is above a predetermined value, the first pump 26 remains in the Off-mode. If the pressure of the first working fluid flowing through the liquid line 45 is below the predetermined value, the control module 62 turns the first pump 26 to the ON-mode, thereby increasing the pressure of the first working fluid as it flows through the first pump 26 and into the first fluid passageway 46 and the second fluid passageway 48. This, in turn, allows the first working fluid to have the requisite pressure and temperature across the first and second expansion devices 28, 32, thus, avoiding hunting 32 (i.e., excessive opening and closing of the first and second expansion devices 28, 32 in order to maintain a constant operating condition) of the first and second expansion devices 28.

The first working fluid in the first fluid passageway 46 flows through the first expansion device 28 and the third heat exchanger 30 and back into the first compressor 20 via the first suction line 38 and the first inlet 34.

The first working fluid in the second fluid passageway 48 flows through the second expansion device 32 and the first conduit 50 where it absorbs heat from the second working fluid of the second working-fluid circuit 14 (via the second conduit 60 of the first heat exchanger 16). In this way, the cooled second working fluid exiting the second conduit 60 flows to the second pump 56 where the second working fluid is pumped to the fourth heat exchanger 58 disposed in the storage tank 18 and absorbs heat from the phase-change material 61, which cools the phase-change material 61 and may turn the phase-change material into a solid (i.e., ice). The second working fluid exiting the fourth heat exchanger 58 flows back through the second conduit 60 of the first heat exchanger 16 where the first working fluid in the first conduit 50 again absorbs heat from the second working fluid in the second conduit 60. The climate-control system 10 can operate to charge or discharge the thermal storage tank 18 at times when the cost of electricity is relatively low (e.g., charging at night). From the first conduit 50, the first working fluid flows into the second compressor 22 where it is compressed and discharged back into to the first compressor 20.

When operating the climate-control system 10 in the discharge mode (FIG. 2), the control module 62 shuts down the first and second compressors 20, 22 and the second expansion device 32, and opens the bypass valve 54 and the valve 64 disposed at a third fluid passageway 68. The first working fluid in the first working-fluid circuit 12 flows through the bypass passageway 52 and the first conduit 50 of the first heat exchanger 16 where heat is transferred from the first working fluid to the second working-fluid circuit (via the second conduit 60). In this way, the second working fluid exiting the second conduit 60 is pumped (via the second pump 56) through the fourth heat exchanger 58 disposed in the storage tank 18 where the second working fluid transfers heat to the phase-change material 61, which cools the second working fluid prior to the second working fluid flowing back through the second conduit 60. The climate-control system 10 can operate to charge or discharge the thermal storage tank 18 at times when the cost of electricity is high (e.g., discharging during the day).

From the first conduit 50, the first working fluid flows through the third fluid passageway 68 and is pumped to the first fluid passageway 46 (via the first pump 26).

One of the benefits of the climate-control system 10 of the present disclosure is that the first pump 26 can be used to increase the pressure of the first working fluid received from the liquid line prior to being pumped to the first and second expansion devices 28, 32, thus, avoiding hunting of the first and second expansion devices 28, 32. In this way, when the climate-control system 10 is in the charge-mode and the ambient temperature (i.e., outside temperature) is cool (e.g., 60 degrees Fahrenheit or below), the first working fluid discharged from the first compressor 20 may be reduce to 50 degrees Fahrenheit, for example, thereby allowing a reduction in power of the first compressor 20 (or other compressors in the climate control system 10) and the fan (not shown) that may force the ambient air over the second heat exchanger 24 to cool the first working fluid therein.

Although the first and second compressors 20, 22 are shown as single compressors, it should be understood that each compressor 20, 22 may be replaced with a plurality of compressors connected in parallel.

It should also be understood that the first pump 26 may continue to operate even when the climate-control system 10 is fully charged.

In this application, the term "module" or "control module" may be replaced with the term circuit. The term "module" may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

In this application, apparatus elements described as having particular attributes or performing particular operations are specifically configured to have those particular attributes and perform those particular operations. Specifically, a description of an element to perform an action means that the element is configured to perform the action. The configuration of an element may include programming of the element, such as by encoding instructions on a non-transitory, tangible computer-readable medium associated with the element.

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112 (f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate-control system comprising:

a first working-fluid circuit including a first compressor, a second heat exchanger and a first pump, the second heat exchanger in fluid communication with the first compressor, the first pump receiving a first working fluid from the second heat exchanger and circulating the first working fluid through the first working-fluid circuit;

a second working-fluid circuit fluidly isolated from the first working-fluid circuit and including a second pump and a fourth heat exchanger, the second pump in fluid communication with the fourth heat exchanger; and a first heat exchanger thermally coupled with the first working-fluid circuit and the second working-fluid circuit, wherein the first working-fluid circuit includes a first fluid passageway, a second fluid passageway, and a third fluid passageway, wherein the climate-control system is operable in a first mode and in a second mode, wherein the first working fluid flows through the first and second fluid passageways and is restricted from flowing through the third fluid passageway when the climate-control system is in the first mode, and wherein the first working fluid flows through the first and third fluid passageways and is restricted from flowing through the second fluid passageway when the climate-control system is in the second mode.

2. The climate-control system of claim 1, wherein the first working-fluid circuit and the second working-fluid circuit are in a heat transfer relationship with each other.

3. The climate-control system of claim 2, wherein the first working-fluid circuit includes a third heat exchanger, and wherein the third heat exchanger is disposed downstream of the first pump.

4. The climate-control system of claim 3, wherein the first working-fluid circuit includes a first expansion device, and wherein the first expansion device is disposed downstream of the first pump and upstream of the third heat exchanger.

5. The climate-control system of claim 4, wherein the first working-fluid circuit includes a second expansion device, and wherein the second expansion device is disposed downstream of the first pump and between the first pump and a conduit of the first heat exchanger.

6. The climate-control system of claim 5, wherein the first working-fluid circuit includes a second compressor, and wherein the second compressor is disposed between the conduit of the first heat exchanger and the first compressor.

7. The climate-control system of claim 1, further comprising a storage tank containing phase-change material, and wherein the storage tank is thermally coupled with the second working-fluid circuit.

8. The climate-control system of claim 7, wherein the fourth heat exchanger of the second working-fluid circuit is disposed within the storage tank.

9. The climate-control system of claim 1, wherein the first pump is in an ON-mode when the climate-control system is in the first mode.

10. The climate-control system of claim 1, wherein a second working fluid circulates through the second working-fluid circuit, and wherein the first working fluid and the second working fluid are different substances.

11. The climate-control system of claim 1, wherein first and second expansion devices control flow through the first and second fluid passageways, respectively.

12. The climate-control system of claim 1, wherein the first heat exchanger includes a first conduit and a second conduit, wherein the first conduit is a part of the first working-fluid circuit, wherein the second conduit is a part of the second working-fluid circuit, and wherein the first and second conduits are in a heat transfer relationship with each other.

13. A climate-control system comprising:

a first working-fluid circuit including a first compressor, a second heat exchanger and a first pump, the second heat exchanger in fluid communication with the first compressor, the first pump receiving a first working fluid from the second heat exchanger and circulating the first working fluid through the first working-fluid circuit;

a second working-fluid circuit fluidly isolated from the first working-fluid circuit and including a second pump and a fourth heat exchanger, the second pump in fluid communication with the fourth heat exchanger; and a first heat exchanger thermally coupled with the first working-fluid circuit and the second working-fluid circuit, wherein the first working-fluid circuit includes first and second fluid passageways, and wherein first and second expansion devices control flow through the first and second fluid passageways, respectively, and wherein the first working-fluid circuit includes a third fluid passageway, and wherein a valve controls flow through the third fluid passageway.

14. The climate-control system of claim 13, wherein the climate-control system is operable in a charge mode and a discharge mode.

15. The climate-control system of claim 14, wherein the first working fluid flows through the first and second fluid passageways and is restricted from flowing through the third fluid passageway when the climate-control system is in the charge mode, and wherein the first working fluid flows through the first and third fluid passageways and is restricted from flowing through the second fluid passageway when the climate-control system is in the discharge mode.

16. The climate-control system of claim 13, wherein the first heat exchanger includes a first conduit and a second conduit, wherein the first conduit is a part of the first working-fluid circuit, wherein the second conduit is a part of the second working-fluid circuit, wherein the first and second conduits are in a heat transfer relationship with each other, wherein a second working fluid circulates through the second working-fluid circuit, and wherein the first working fluid and the second working fluid are different substances.

17. A climate-control system comprising:

a first working-fluid circuit including a first compressor, a second heat exchanger and a first pump, the second heat exchanger in fluid communication with the first compressor, the first pump receiving a first working fluid from the second heat exchanger via a fluid line and circulating the first working fluid through the first working-fluid circuit;

a second working-fluid circuit including a second pump and a fourth heat exchanger, the second pump in fluid communication with the fourth heat exchanger;

a first heat exchanger thermally coupled with the first working-fluid circuit and the second working-fluid circuit;

a pressure sensor coupled to the fluid line; and a control module in communication with the first pump and the pressure sensor, wherein the control module operates the first pump in an ON-mode when the climate-control system is in a charge mode and a pressure of the first working fluid in the fluid line is below a predetermined value, wherein the first working-fluid circuit includes a first fluid passageway, a second fluid passageway, and a third fluid passageway, wherein first and second expansion devices control flow through the first and second fluid passageways, respectively, and wherein a valve controls flow through the third fluid passageway.

18. The climate-control system of claim 17, further comprising a storage tank containing phase-change material, and wherein the storage tank is thermally coupled with the second working-fluid circuit and the fourth heat exchanger of the second working-fluid circuit is disposed within the storage tank.

19. The climate-control system of claim 17, wherein the first working fluid flows through the first and second fluid passageways and is restricted from flowing through the third fluid passageway when the climate-control system is in the charge mode, and wherein the first working fluid flows through the first and third fluid passageways and is restricted from flowing through the second fluid passageway when the climate-control system is in a discharge mode.

20. The climate-control system of claim 17, wherein the first working-fluid circuit fluidly isolated from the second working-fluid circuit.

21. The climate-control system of claim 17, wherein the first heat exchanger includes a first conduit and a second conduit, wherein the first conduit is a part of the first working-fluid circuit, wherein the second conduit is a part of the second working-fluid circuit, and wherein the first and second conduits are in a heat transfer relationship with each other.

* * * * *